US005746177A

United States Patent [19]

Criss et al.

[11] Patent Number: 5,746,177

[45] Date of Patent: May 5, 1998

[54] T-SLOT THROTTLE BODY SHAFT

[75] Inventors: James L. Criss, Cement City; Linda J. Fry, South Lyon, both of Mich.

[73] Assignee: Ford Motor Company, Dearborn, Mich.

[21] Appl. No.: 676,847

[22] Filed: Jul. 8, 1996

[51] Int. Cl.[6] ..... F02D 9/10

[52] U.S. Cl. ..... 123/337; 251/308

[58] Field of Search ..... 123/336, 337; 251/304, 308; 261/65

[56] References Cited

U.S. PATENT DOCUMENTS

| | | | |
|---|---|---|---|
| 2,080,440 | 5/1937 | Scott | 261/65 |
| 2,753,147 | 7/1956 | Welge | 251/233 |
| 4,438,745 | 3/1984 | Watanabe | 123/337 |
| 4,880,207 | 11/1989 | Matsumoto et al. | 251/337 |
| 4,972,815 | 11/1990 | Yamamoto et al. | 123/337 |
| 5,081,972 | 1/1992 | Daly et al. | 123/337 |

FOREIGN PATENT DOCUMENTS 235629 9/1988 Japan .

*Primary Examiner*—Tony M. Argenbright
*Attorney, Agent, or Firm*—Donald A. Wilkinson

[57] ABSTRACT

A throttle body (10) for use with an air intake system of an internal combustion engine. The throttle body (10) includes a throttle valve (18), which includes a throttle plate (20) mounted to a throttle shaft (22) within a slot (26). The throttle shaft also includes a notch (32) extending between the slot (26) and the surface of the throttle shaft (22). The notch (32) allows for ease of manufacturing and assembly and also allows for a slight increase in air flow past the throttle valve with minimal reduction in bending strength of the shaft.

5 Claims, 1 Drawing Sheet

T-SLOT THROTTLE BODY SHAFT

FIELD OF THE INVENTION

The present invention relates to throttle bodies used in air intake systems of internal combustion engines and more particularly to the throttle valves mounted within the throttle bodies.

BACKGROUND OF THE INVENTION

A typical throttle body used in an air intake system of an internal combustion engine employs a throttle valve to throttle the air flow through the throttle body. A butterfly valve is employed as the throttle valve. This type of throttle valve includes a throttle shaft rotatably mounted to the throttle body and a throttle plate mounted to the throttle shaft within a main bore which can be rotated by the throttle shaft to selectively restrict the air flow through the main bore.

Two configurations for mounting the throttle plate to the throttle shaft are a straight slot or a slab. With the slab configuration, a channel is cut out of the throttle shaft The channel extends the diameter of the throttle plate and is generally cut to a depth such that the throttle shaft is left with a semi-circular cross-section in this area. Thus, half of the cross-sectional area of the throttle shaft is removed for receiving the throttle plate.

The throttle plate is typically fastened to the throttle shaft with a pair of fasteners. With this configuration, the manufacturing is relatively easy since the cut into the throttle shaft is an external cut and the assembly is also simple since the plate can simply be brought to rest in the channel and fastened into place. However, because of the channel in the throttle shaft, the slab design suffers from a substantially reduced strength in bending. Consequently, a larger overall diameter shaft may be required in order to allow for adequate bending strength in the shaft around the channel.

This bending weakness in the slab design leads some to use a slot type of design for the throttle plate. The throttle shaft in the slot configuration includes a slot through the center of the shaft extending longitudinally along the shaft a length approximately equal to the diameter of the throttle plate. The slot is just slightly wider than the width of the throttle plate to allow for insertion. With just a slot into the shaft, more of the overall bending strength of the shaft is retained for a given diameter relative to a slab shaft. Thus, the overall diameter of the shaft can be smaller.

On the other hand, though, the manufacturing is more difficult than with a slab design. The cut-out for the slot is enclosed and so the tools able to form the slot are more limited. An example is a fabrication operation requiring both an initial saw cut and then a final broaching operation to form the slot to its final dimensions. On the other hand, assembly is relatively easier than with a slab design since the plate can be inserted into the slot, making it easier to hold the two together while the fastener holes are aligned properly.

Further, the slot design, by leaving more material around the throttle plate, reduces the flow area for the air somewhat relative to the slab design. Although, the slab design also restricts the flow area somewhat by the fact that the diameter of the throttle shaft must be larger to account for the reduced bending strength of the shaft. Ideally, the shaft has a minimum of area exposed to the air stream, since it provides a restriction to air flow.

Thus, a desire exists for a throttle valve configuration that has the strength of a slotted design with the ease of fabrication of a slab design, and further one which minimizes the restriction that the throttle shaft presents to air flow through the throttle body.

SUMMARY OF THE INVENTION

In its embodiments, the present invention contemplates a throttle valve for use with a throttle body of an internal combustion engine. The throttle valve comprises a disk shaped throttle plate and a throttle shaft. The throttle shaft is generally cylindrical with a longitudinal axis and includes a slot through the shaft, generally normal to the longitudinal axis and extending longitudinally a portion of its length, with the shaft also including a notched portion forming an opening from the slot to the outer surface of the shaft on one side. The throttle valve also includes means for securing the throttle plate to the throttle shaft within the slot.

Accordingly, an object of the present invention is to provide a throttle valve which employs a throttle shaft having a configuration for mounting a throttle plate that allows for ease of fabrication, minimizes the air flow restriction in the throttle body due to the throttle shaft and maintains adequate bending strength for a given diameter of throttle shaft.

An advantage of the present invention is that a throttle valve shaft results in an increase in strength and durability relative to a slab shaft with slightly improved air flow, and consequently horsepower, and small weight reduction relative to a slotted shaft.

An additional advantage of the present invention is the capability to form an open slotted shaft by machining rather than the generally required broaching on a closed slotted shaft and an ease of assembly of the throttle plate to the shaft more like that of a slotted shaft.

DETAILED DESCRIPTION OF THE PREFERRED EMBODIMENTS

Figure 1:
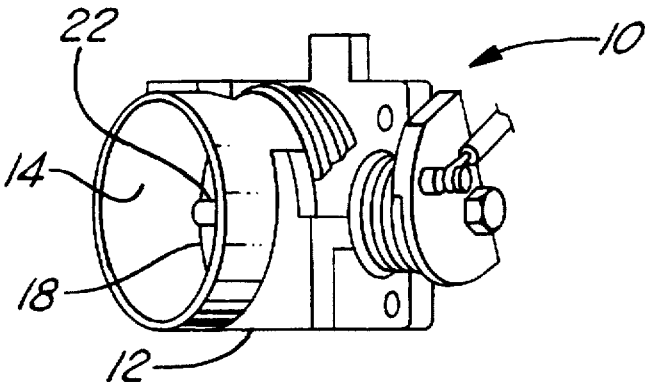
FIG. 1 is a perspective view of a throttle body in accordance with the present invention.
Figure 2:
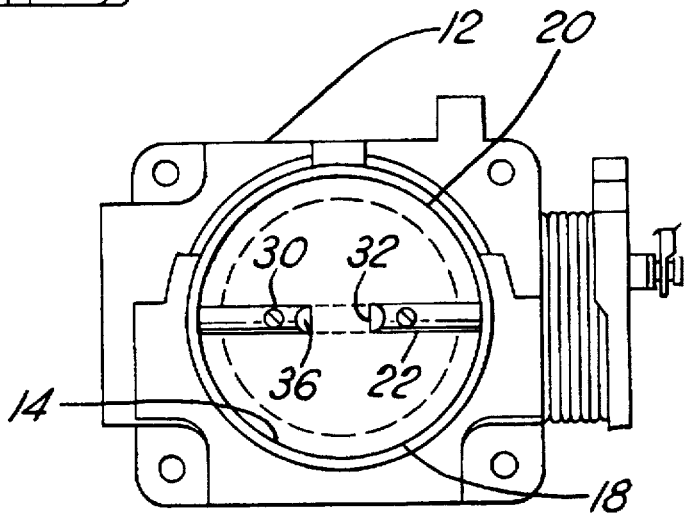
FIG. 2 is a plan view of the throttle body of FIG. 1.
Figure 3:
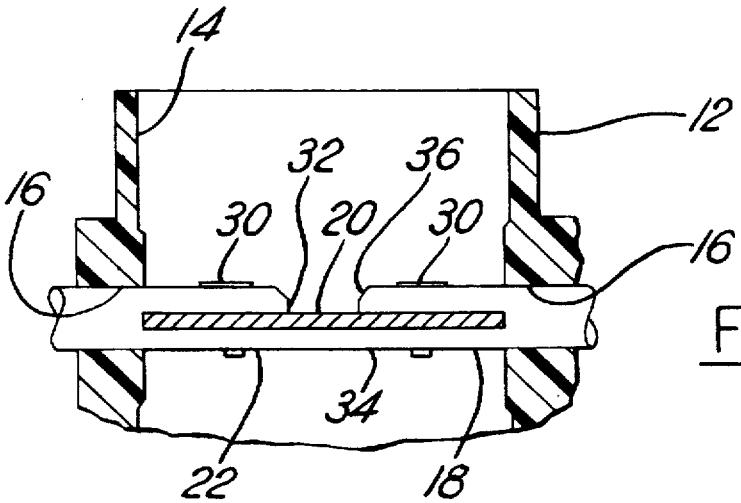
FIG. 3 is a side, partial sectional view of the throttle body of FIG. 1.
Figure 4:
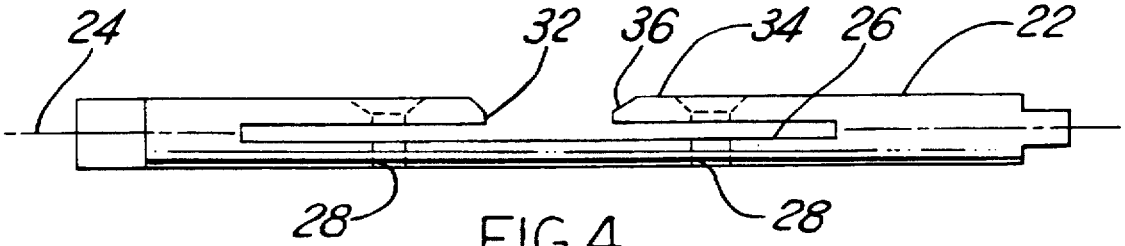
FIG. 4 is a side view of the throttle shaft.

A throttle body 10 mounts to a typical air intake system of a typical internal combustion engine (not shown). The throttle body includes a main housing 12, which includes a main bore 14. The housing 12 also includes a throttle-shaft bore 16 that extends generally normal to the main bore 14. A throttle valve 18 mounts within the main bore 14 at the location of the throttle-shaft bore 16.

The throttle valve 18 includes a throttle plate 20, which has the conventional flat disk shape of a butterfly valve and is sized to allow for complete or partial restriction of the main bore 14 depending upon its orientation. The throttle valve 18 also includes a throttle shaft 22. The throttle shaft 22 is sized to just mount within the throttle shaft bore 16 and rotate therein about a longitudinal axis of rotation 24. The throttle shaft 22 also includes a slot 26 cut normal to its axis 24, which extends along its length a sufficient distance to receive the throttle plate 20. The slot 26 is located to align the throttle plate 20 within the main bore 14.

The slot 26 itself is preferably machined to net shape in an initial saw operation, eliminating the need for a broaching operation as is required with a conventional slotted shaft. This can be accomplished because the slot 26 is not completely closed, as will be discussed below.

The throttle shaft 22 also includes a pair of partially threaded fastener holes 28 through it. Screws 30 are received in the holes 28 and secure the throttle plate 20 to the throttle shaft 22 at the proper location within the throttle body 10. The throttle plate 20 used in this assembly can be the same as those used with conventional slotted throttle shafts since the spacing and size of attachment screws 30 can easily be maintained from one to the other. This allows for reduced expense for the throttle plate 20.

The throttle shaft 22 also includes a notch 32 extending between the slot 26 and the outer surface 34 of the throttle shaft 22 on one side, with the slot and notch forming a T-shaped type of cut-out in the shaft 22. A chamfered lead 36 is formed around the outer edge of the notch 32 for ease of assembly of the shaft 22 into the throttle-shaft bore 16.

The notch 32 effectively makes the slot 26 an open cut-out in the shaft 22. This makes forming of the slot 26 easier since a saw blade can pass all of the way through the slot with the spindle of the saw passing through the notch 32. Further, since a portion of the shaft 22 is affixed on both sides of the plate 20, the bending strength of the shaft 22 is greater than with a conventional slab design. The notch 32 also reduces the area of the shaft 22 exposed to the air flow stream, thus reducing the air flow restriction. This allows for a slight increase in air flow and consequently increased horsepower.

While certain embodiments of the present invention have been described in detail, those familiar with the art to which this invention relates will recognize various alternative designs and embodiments for practicing the invention as defined by the following claims.

We claim:

1. A throttle valve for use with a throttle body of an internal combustion engine comprising:

a disk shaped throttle plate;

a throttle shaft, being generally cylindrical with a longitudinal axis and including a slot through the shaft, generally normal to the longitudinal axis and extending longitudinally a portion of its length, with the shaft also including a notched portion forming an opening from the slot to the outer surface of the shaft on one side; and means for securing the throttle plate to the throttle shaft within the slot.

2. The throttle valve of claim 1 wherein the notch includes a chamfer on the edge of the notch extending up to the outer surface of the shaft.

3. The throttle valve of claim 1 wherein the means for securing the throttle plate comprises a plurality of threaded holes through the throttle shaft, a corresponding number of holes through the throttle plate aligned with the holes in the throttle shaft, and a corresponding number of screws threaded through the holes.

4. A throttle body for use with an internal combustion engine comprising:

a throttle body housing including a main bore and a throttle valve bore generally normal to the main bore;

a throttle shaft mounted such that it extends across the main bore, with the throttle shaft being generally cylindrical with a longitudinal axis and including a slot through the shaft, generally normal to the longitudinal axis and extending longitudinally a portion of its length, with the shaft also including a notched portion forming an opening from the slot to the outer surface of the shaft on one side;

a disk shaped throttle plate mounted within the slot in the throttle shaft such that the throttle plate is mounted within the main bore; and means for securing the throttle plate to the throttle shaft within the slot.

5. A throttle valve for use with a throttle body of an internal combustion engine comprising:

a disk shaped throttle plate;

a throttle shaft, being generally cylindrical and including a slot formed in the shaft, generally normal to the shaft axis and extending a portion of its length, and a notched portion extending from the slot to the outer surface of the shaft, with the slot formed by a saw cut through the shaft after the notch is formed in the shaft; and means for securing the throttle plate to the throttle shaft within the slot.

* * * * *